United States Patent [19]

McMahon, Jr. et al.

[11] 4,252,539

[45] Feb. 24, 1981

[54] SOLID FUEL COMPOSITION

[75] Inventors: Matthew A. McMahon, Jr., Wappingers Falls, N.Y.; George C. Meldrum, Austin, Tex.

[73] Assignee: Texaco Inc., White Plains, N.Y.

[21] Appl. No.: 57,132

[22] Filed: Jul. 12, 1979

[51] Int. Cl.[3] ..... C10L 5/00

[52] U.S. Cl. ..... 44/1 B

[58] Field of Search ..... 44/1 B, 1 R

[56] References Cited

U.S. PATENT DOCUMENTS 4,119,409 10/1978 Aoki et al. ..... 44/1 B

*Primary Examiner*—Carl F. Dees

*Attorney, Agent, or Firm*—Carl G. Ries; Robert A. Kulason; Robert Knox, Jr.

[57] ABSTRACT

A process for the production of a normally solid fuel composition wherein solvent refined coal is combined with raw coal at a temperature in the range of 200° to 400° C. and the product produced thereby. The resulting product, on cooling, is a hard, non-pyrophoric, oxidatively stable solid composition which is resistant to disintegration and powder formation, and which may be stored, transported, and used in power plants and the like without any special precautions. Alternatively, the product, which has a relatively low melting point, can be handled as a liquid. The sensible heat of the solvent refined coal has a beneficial effect on the heating value and sulfur content of the raw coal, producing a product superior to dry mixing of solidified solvent refined coal and raw coal.

5 Claims, No Drawings

SOLID FUEL COMPOSITION

This invention relates to a solid fuel composition comprising coal and to a process for the preparation of said composition. In one of its more specific aspects, a solid fuel composition particularly useful as a power plant fuel is prepared from coal and solvent refined coal. The process of this invention provides a means for supplementing the supply of high grade, low sulfur coals by providing a composite product containing lower grade coal and various fractions derived from lower grade coal suitable for use in existing facilities, such as industrial boilers, heaters, furnaces, and power plants.

The critical shortage of crude oil and petroleum products in various parts of the world, including the United States, is well known. Also, it is well known that in many circumstances coal or liquid derived from coal can be substituted for petroleum based fuels. One impediment to the free substitution of coal for oil or gas in electric power generation plants results from United States Government regulations which restrict the relative quantities of sulfur compounds and oxides of nitrogen which may be discharged into the atmosphere. For example, Government regulations in effect in the United States at the present time permit no more than 1.2 pounds of sulfur dioxide to be discharged into the atmosphere for every million British Thermal Units (Btu's) (about 0.516 g/MJ) of fuel burned in new stationary power plants. Many of the coal reserves in the United States contain too much sulfur to meet this regulation. The demand for low sulfur coals and fuel oils in recent years have been so great relative to the quantities available that it is no longer feasible to supply all of the electrical generation plants with the required amounts of clean fossil fuels. There are, on the other hand, still abundant supplies especially in the United States of lower grade fuels and of fuels having relatively high sulfur contents or relatively high nitrogen contents, or both.

It has been proposed heretofore to liquefy coal by treating it with hydrogen or with synthesis gas (a mixture of hydrogen and carbon monoxide) at high temperatures and pressures. This treatment eliminates ash from the fuel and reduces the sulfur level in the liquefied coal fraction sufficiently to meet governmental regulations.

The process of this invention comprises a novel method of preparing a fuel derived from coal which utilizes liquefied coal and extends it with lower grade coals to thereby increase the supply of available fuels which are capable of meeting the stringent governmental controls regulating power plant emissions. The present invention provides not only a means of preparing a low sulfur fuel meeting governmental requirements, but also provides a method of producing a relatively low sulfur fuel more economically than present methods of production.

The process of this invention provides a novel method of producing a fuel composition having relatively low sulfur content from coals having a relatively high sulfur content.

In accordance with the process of the present invention, a carbonaceous fuel is prepared by blending solvent refined coal with raw coal at a temperature in the range of 200° to 370° C. (ca. 400° to 700° F.), preferably in the range of 315° to 370° C. (600° to 700° F.). The resulting product, which may be in solid or fluid form as desired, has a higher heating value than the composite heating value of the two fuels combined to form the final product. This increase in heating value results in part from the reduction in the water and carbon dioxide content of the raw coal which occurs when the raw coal is blended with hot solvent refined coal from a coal solvent refining operation.

An advantage of the process of the present invention is that it permits the upgrading of coals of lower heating value and relatively high sulfur contents to such an extent that, upon combustion, no more than 1.2 pounds of sulfur dioxide is generated for every million Btu's of fuel burned. It will be understood that the composition may be varied to meet other regulations or criteria. The amount of raw coal that can be blended with solvent refined coal is limited by the amount of sulfur in the raw coal and by the viscosity or thickness of the blend that is prepared. It is generally desirable to prepare a blend which may be pumped or extruded with conventional pumping or extrusion equipment. In general, a pumpable mixture may be prepared with relative proportions of powdered raw coal to solvent refined coal containing not more than about 50 weight percent raw coal.

By the term "solvent refined coal" is meant a liquid fraction which is obtained when coal is subjected to reaction with hydrogen at elevated temperatures and pressures. A number of processes are known for the production of solvent refined coal. Such processes generally produce a product known as solvent refined coal which represents a fraction of the coal which may be extracted from raw coal by means of a highly aromatic solvent. The extract, after the separation of volatiles, and the insoluble residue of the coal is known as solvent refined coal. In solvent refining of coal, a variety of coals may be processed, for example, lignite, subbituminous, and bituminous coals, may be employed as feed for the solvent refined coal process. Powdered raw coal is mixed with a suitable solvent, for example, a polycyclic aromatic hydrocarbon, including tetralin, decalin, dihydronaphthalene, and the like. The process is carried out at a sufficiently elevated temperature and pressure to maintain the hydrocarbons in the liquid phase at a reaction temperature in the range of about 300° to 500° C. Some hydrocarbon oils, especially hydroaromatics, such as tetralin, decalin, and heavy oils obtained by hydrogenation of coal, act as solvents and aid in the liquefaction of the coal. At the more elevated temperatures, particularly temperatures of about 370° C. and above, there is a condensation of free radicals or unsaturated compounds generated by thermal decomposition of coal substance into materials more stable than the original coal substance. It is generally preferable, therefore, to maintain the temperature in the coal refining process below about 400° C.

Ash and non-liquefiable fractions of the coal are not liquefied in the process and are usually removed by filtration. The solvent phase, that is the ash-free, liquefied mixture of solvent and soluble constituents of the original coal substance is subjected to vacuum distillation for the removal of solvent. The coal liquefaction step may be carried out at an elevated pressure in the range of from about 50 to 500 atmospheres (5,000 to 50,000 kPa) with a residence time of from 1 minute to 2 hours. The solvent to coal ratio may vary but generally is in the range of about 2 to about 15. Hydrogen in the range of about 1 cubic meter per kilogram of coal is usually required in the process. Recovered solvent, which acts as a hydrogen donor for the coal during the solvation process, is recycled. The process may be carried out non-catalytically or in the presence of a suitable catalyst, such as a metal of the first transitional series of Group VIII of the Periodic Table, which includes iron, cobalt, and nickel. Vacuum distillation of the residue for the recovery of solvent therefrom is usually carried out at a pressure in the range of 0.05 to 0.5 atmospheres (5 to 50 kPa) and at a temperature in the range of about 275° to 320° C.

The resulting hot residue is liquid at temperatures of about 260° C. and higher and may contain of the order of 50 percent by weight ash. When cooled, the residue solidifies to a friable solid which may be reliquefied on heating and is suitable for the generation of hydrogen and carbon monoxide by direct partial oxidation by the well known Texaco Synthesis Gas Generation Process.

Preferably, the blend of raw coal and solvent refined coal (SRC) in accordance with the present invention is made up at the site where the solvent refined coal is produced so that the SRC product after the separation of ash and volatile solvents therefrom may be taken directly without cooling and while at a temperature in the range of about 250° to 375° C. to the process of the present invention in which the hot solvent refined coal is blended with powdered raw coal. Preferably the raw coal used in the process of this invention has been previously dried. The mixture of raw coal and hot SRC is preferably permitted to cool gradually to obtain the maximum benefit of heat treatment of the raw coal at the 250° to 375° C. temperature range for several minutes. When the solvent refined coal-raw coal blend is cooled to room temperature, it solidifies into a dense, friable solid. This solid may be crushed to any desirable particle size. Overly fine particles formed in crushing may be recycled to the process. The solid product of the process is not pyrophoric, it is oxidatively stable, and can be economically transported to market by the usual shipping methods. The method of this invention overcomes a problem associated with some of the coals produced in western regions of the United States. Many of the western regions coals contain 25 to 50 percent by weight water. The water may be removed by conventional thermal drying methods, but the dried lignites and sub-bituminous coals are oxidatively unstable and sometimes pyrophoric. Blending conventionally dried coal with solvent refined coal in accordance with the process of this invention produces a stable, non-pyrophoric product that may be stored and transported in a conventional manner.

The process of this invention results in a product which is more economical to manufacture and market than solvent refined coal, which requires the use of high pressure, high temperature hydrogenation equipment, as only 50 to 70 percent of the product of this invention is composed of solvent refined coal.

In an alternate embodiment of the process of this invention, solvent refined coal containing volatile hydrocarbon solvent, after the separation of solid residue and ash material therefrom by filtration, centriguation, or settling, may be blended with the raw coal to form a fluid mixture which is then subjected to vacuum distillation at a temperature in the range of about 200° to about 375° C. at a reduced pressure in the range of 5 to 50 kPa to effect removal of the solvent from the resulting composite.

The following examples illustrate the present invention and are directed to preferred embodiments of the invention. In the following examples, Lake de Smet (Wyoming) coal was selected as the raw coal, and was pulverized and dried prior to mixing with the solvent refined coal. The coal used in these examples contained 1.8 percent sulfur (dry basis) and 12.5 weight percent ash (dry basis) and had a higher heating value of 2.34 to MJ/Kg (10,070 Btu's per pound) of dry coal. The following is a U.S. Standard sieve analysis of the size ranges of the pulverized coal.

TABLE I

| Sieve Analysis | |
|---|---|
| Mesh | Wt. % |
| +60 | 35 |
| 60-100 | 16 |
| 100-200 | 21 |
| 300-325 | 5 |
| −325 | 23 |

The pulverized coal was slowly added to the molten solvent refined coal with continuous stirring. In Example 1, the solvent refined coal contains 0.45 Wt.% sulfur, and has a melting point of 115° C. and a higher heating value of 3.69 MJ/Kg (15,870 Btu's per pound).

The solvent refined coal employed in Example 2 has a higher heating value of 3.68 MJ/Kg (15,805 Btu's per pound). In Example 1, a blend was prepared from 71 percent by weight solvent refined coal and 29 percent by weight of cleaned, dry Lake De Smet coal of the composition given in Table I above. The composition was prepared at 204° C. (400° F.). The properties of the product as compared with the properties of a dry mixture of pulverized solid solvent refined coal and raw coal of the same compositions are indicated in the following table:

TABLE II

| Product Analysis | Observed | Dry Mixture |
|---|---|---|
| Water, Wt. % | 0.8 | 3.0 |
| Sulfur, Wt. % | 0.81 | 0.84 |
| Heating Value | | |
| MJ/kg | 3.298 | 3.300 |
| Sulfur Dioxide | | |
| g/MJ | 0.490 | 0.507 |
| lb./Btu × $10^6$ | 1.14 | 1.18 |
| Reduction in $SO_2$ Emissions, % | 3 | — |
| Melting Point, °C. | 135 | — |

EXAMPLE 2

Feed coal having the properties set forth in Table I was blended with a solvent refined coal having the following properties: Sulfur, Wt. % 0.58; Heating Value MJ/Kg 3.676 (15,805 Btu's/lb.); melting point 120° C. in relative proportions of 71 weight percent solvent refined coal and 29 weight percent pulverized raw coal. The mixture was prepared at 316° C. (600° F.). The properties of the product as compared with the properties of a dry mixture of pulverized solid solvent refined coal and raw coal of the same compositions are indicated in the following table:

TABLE III

| Product Analysis | Observed | Dry Mixture |
|---|---|---|
| Water, Wt. % | 0.9 | 2.6 |
| Sulfur, Wt. % | 0.82 | 0.93 |
| Heating Value | | |
| Mg/Kg | 3.377 | 3.289 |
| lb./Btu × $10^6$ | 14.520 | 14.140 |
| Sulfur dioxide | | |
| g/MJ | 0.486 | 0.563 |
| lb./Btu × $10^6$ | 1.13 | 1.31 |

TABLE III-continued

| Product Analysis | Observed | Dry Mixture |
|---|---|---|
| Reduction in $SO_2$ Emissions, % | 14 | — |
| Melting Pint, ° C. | 210 | — |

It is evident from the foregoing specific examples that coal which cannot meet U.S. Government sulfur dioxide emission requirements can be blended with solvent refined coal to produce a fuel of high heating value that will meet Environmental Protection Authority regulations. It is also evident, particularly from Example 2, that the process resulted in some desulfurization of the raw coal.

We claim:

1. A process for the manufacture of a normally solid carbonaceous fuel which comprises blending solvent refined coal containing volatile hydrocarbon solvent with particulate raw coal to form a fluid mixture and subjecting said mixture to distillation at a temperature in the range of about 200° to 375° C. at reduced pressure to effect removal of the solvent.

2. A method according to claim 1 wherein said mixture of solvent refined coal and raw coal is maintained at a temperature in the range of 260° to 370° C. for a period of time in the range of about 5 to 60 minutes.

3. The process of claim 1 in which solide residue and ash is removed from the solvent refined coal containing volatile hydrocarbon solvent prior to the blending with the raw coal.

4. The process of claim 1 in which the reduced pressure is in the range of 5–50 kPa.

5. A stable non-pyrophoric solid fuel composition prepared by blending solvent refined coal containing volatile hydrocarbon solvent with particulate raw coal to form a fluid mixture and subjecting said mixture to vacuum distillation at a temperature in the range of about 200° to 375° C. at reduced pressure in the range of 5 to 50 kPa to effect removal of the solvent from the resulting composite.

* * * * *